US007305200B2

(12) United States Patent
Hoffman et al.

(10) Patent No.: US 7,305,200 B2
(45) Date of Patent: Dec. 4, 2007

(54) PRINTING SYSTEM WITH EXTENDED COLOR GAMUT

(75) Inventors: Matthew F Hoffman, Ontario, NY (US); Paul M. Butterfield, Ontario, NY (US); Mark P. Haefner, Pittsford, NY (US); Christopher J. Degroff, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 246 days.

(21) Appl. No.: 11/261,341

(22) Filed: Oct. 28, 2005

(65) Prior Publication Data

US 2007/0098430 A1 May 3, 2007

(51) Int. Cl.
*G03G 15/00* (2006.01)
*G03G 15/01* (2006.01)

(52) U.S. Cl. ..... 399/82; 399/15; 399/39; 399/401

(58) Field of Classification Search ..... 399/15, 399/82, 39, 38, 401; 358/1.4, 1.9, 518
See application file for complete search history.

(56) References Cited

U.S. PATENT DOCUMENTS 5,381,220 A * 1/1995 Acquaviva et al. ..... 399/367
5,781,828 A 7/1998 Caruthers, Jr. et al.
5,892,891 A 4/1999 Dalal et al.
6,028,616 A * 2/2000 Kovacs et al. ..... 347/155
6,173,952 B1 1/2001 Richards et al.
6,307,645 B1 10/2001 Mantell et al.
6,684,045 B2 1/2004 Viturro et al.
6,894,805 B2 5/2005 Degani et al.
6,920,307 B2 7/2005 Howe
6,938,984 B2 9/2005 German et al.
2003/0133721 A1 * 7/2003 Brewington ..... 399/19

* cited by examiner

*Primary Examiner*—Sophia S. Chen
(74) *Attorney, Agent, or Firm*—Fay Sharpe LLP

(57) ABSTRACT

A printing system includes a marking engine which applies colorants to a print medium to render an image. The marking engine has a single pass color gamut which the marking engine is capable of rendering in a single pass of the print medium through the marking engine. The marking engine is capable of rendering an extended color gamut in a plurality of passes of the print medium through the marking engine. A control system is associated with the marking engine. The control system identifies an image which falls outside the single pass color gamut of the marking engine and schedules a plurality of passes for rendering the image.

20 Claims, 6 Drawing Sheets

PRINTING SYSTEM WITH EXTENDED COLOR GAMUT

BACKGROUND

The present exemplary embodiment relates generally to the printing arts. It finds particular application in conjunction with a printing system which extends the color gamut available with process colors using multi-pass printing. However, it is to be appreciated that the present exemplary embodiment is also amenable to other like applications.

The color demands of images to be rendered by a marking device are usually specified in a device independent color space as part of a page description language (PDL). Color spaces typically used in PDL files include RGB, CMYK, L*a*b*, and PANTONE. L*, a*, b*, for example, are the independent space representations of the CIE (Commission Internationale de L'eclairage) for color standards which are often utilized in the functional modeling of these color demands. L* defines lightness, a* corresponds to the red/green value and b* denotes the amount of yellow/blue. The PDL source color representations are transformed into representations which the device can reproduce with available colorants, such as cyan, magenta, yellow and black (CMYK) representations.

A look up table (LUT) is used to determine which combination of available colorants (typically cyan, magenta, yellow, and black) will yield the desired colors specified. The look up table may be derived by printing test patches and examining the output. The input space (domain) describes all the possible ways of combining the three primary colorants (for example, cyan, magenta, and yellow but many other triplets are possible). Typically, the halftone density of a colorant is specified by an 8 bit integer (a whole number between 0 and 255 in base 10 notation). 255 corresponds to the maximum density which can be achieved. The domain of the transformation consists of a three dimensional cube, 255 units on a side with one corner at the origin. The co-domain space of the transformation is the color gamut of the marking device, the three dimensional volume that indicates all the L*, a*, b* values which are accessible by combining the three (or four) colorants.

Different color devices have different color capabilities. Every color device, whether it is a color scanner, a color marking device, or a color display monitor, has a color gamut, i.e., a range of colors that it can capture, produce, or display. While most color display monitors can display hundreds of thousands of colors using gray scale or continuous tones (contone), color marking devices usually have a significantly smaller number of producible colors. In halftone printing, for example, the image is made up of an array of pixels. The chromaticity of a given area is increased by turning on an increasing number of pixels of the colorant. The maximum density of a colorant is achieved, for a given area, when 100% of the pixels are turned on. A pixel is the smallest element of a printing system that can be independently controlled.

Various attempts have been made to expand the color gamut of marking devices, either to allow a closer match with the rendering of an image on a color display monitor, or to produce colors to meet specific customer requests ("custom colors"). Often the colors which tend to be outside the color gamut are those which have a high intensity of two or more of the colorants. In inkjet printing systems and offset lithography, "spot color" or "high-fidelity" color printing has been developed in which conventional cyan, magenta, yellow and black (CMYK) inks are augmented with additional primary colors beyond the usual four primary colors used to produce the process color output. These additional inks are used for extending the color gamut of the process color output (high fidelity color), and thereby more closely emulate standardized spot colors, such as those defined by Pantone. However, additional hardware is needed in the form of printing units.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto the paper is generally accomplished by applying heat to the toner with a heated roller and application of pressure.

Adding an additional colorant in a xerographic marking device poses design problems since the additional equipment includes not only an additional developer housing for the fifth colorant, but also an additional charging corotron and an exposure station.

INCORPORATION BY REFERENCE

The following patents, the disclosures of which are incorporated herein in their entireties by reference, are mentioned:

U.S. Pat. No. 6,684,045 to Viturro, et al., entitled "HYBRID ELECTROPHOTOGRAPHIC APPARATUS FOR CUSTOM COLOR PRINTING" discloses an apparatus for developing an image on an imaging surface, including a first developer unit having dry marking particles therein for developing a first portion of the image; and a second developer unit having a solution of marking particles and liquid carrier therein for developing a second portion of the image. The apparatus extends the functionality of liquid developer to produce custom colors and combines it with a powder development engine to enable custom color printing.

U.S. Pat. No. 5,781,828 to Caruthers, Jr., et al., entitled "LIQUID COLOR MIXING AND REPLENISHMENT SYSTEM FOR AN ELECTROSTATOGRAPHIC PRINTING MACHINE," discloses a system and method for color mixing management in an electrostatographic printing system. A developing material reservoir containing an operative solution of colored developing material including a mixture of selected color components is continuously replenished with selected differently colored developing material concentrates in a predetermined ratio so as to be capable of producing a customer selectable color image area on an output substrate.

U.S. Pat. No. 5,892,891 to Dalal, et al., entitled "SYSTEM FOR PRINTING COLOR IMAGES WITH EXTRA COLORANTS IN ADDITION TO PRIMARY COLORANTS," discloses a "hi-fi" color printing system in which colorants beyond the regular CMYK primary colorants are available. A main gamut obtainable with the CMYK colorants only is mutually exclusive with at least one extended gamut in which a hi-fi colorant is used and a complementary one of the CMY colorants is excluded.

BRIEF DESCRIPTION

In accordance with aspects of the exemplary embodiment, a printing system and a method of printing are provided.

In one aspect, a xerographic printing system includes a marking engine which applies colorants to a print medium to render an image. The marking engine has a single pass color gamut which the marking engine is capable of rendering in a single pass of the print medium through the marking engine and an extended color gamut which the marking engine is capable of rendering in a plurality of passes of the print medium through the marking engine. A control system is associated with the marking engine. The control system identifies an image which falls outside the single pass color gamut of the marking engine and schedules a plurality of passes for rendering the image.

In another aspect, a method of printing includes applying at least one of a plurality of colorants to a print medium in a first pass through a xerographic marking engine. The at least one colorant from the plurality of colorants is applied to the print medium in a second pass through the xerographic marking engine to render an image. The rendered image includes at least one area in which a rendered color falls outside a color gamut of the xerographic marking engine for a single pass of the print medium through the xerographic marking engine.

In another aspect, a printing system includes a marking engine configured for rendering an image by applying a plurality of colorants to a print medium at a transfer point. A color image processing component identifies at least one image from images to be rendered. A scheduling component schedules return of the identified at least one image to the transfer point, whereby the at least one image is marked with at least one of the plurality of colorants at the transfer point and returned to the transfer point to be marked with at least one of the plurality of colorants.

DETAILED DESCRIPTION

Figure 1:
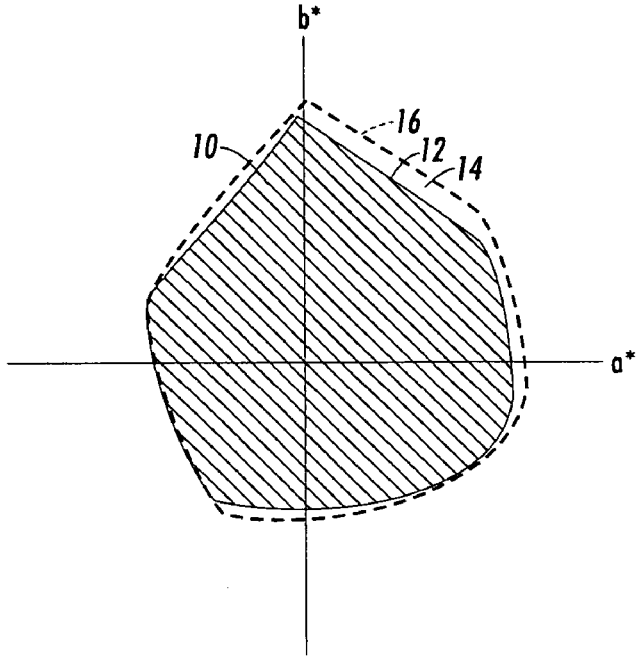
FIG. 1 is a schematic view of the transformation from an L*, a*, b* color space to a marking engine color space (CMYK) in accordance with the exemplary embodiment viewed through the L* axis.

Aspects of the exemplary embodiment relate to a printing system, such as a xerographic printing system, and to a method of printing. The printing system includes a marking engine which applies colorants, such as toners, to a print medium, such as paper, to render an image. The marking engine has a single pass color gamut which the marking engine is capable of rendering in a single pass of the print medium through the marking engine and an extended color gamut which the marking engine is capable of rendering in a plurality of passes of the print medium through the marking engine. A control system is associated with the marking engine. The control system identifies an image which falls outside the single pass color gamut of the marking engine and schedules a plurality of passes for rendering the image.

In other aspects, a method of multi-pass printing includes applying at least one of a plurality of colorants to a print medium in a first pass through a marking engine and applying the at least one colorant from the plurality of colorants to the print medium in a second pass through the marking engine to render an image, whereby the rendered image includes at least one area in which a rendered color falls outside a color gamut of the marking engine for a single pass of the print medium through the marking engine.

The term "marking engine" generally refers to a device for applying an image to print media. "Print media" can be a usually flimsy physical sheet of paper, plastic, or other suitable physical print media substrate for images, whether precut or web fed. The printing system may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

While the printing system is described with particular reference to a xerographic (e.g., laser) printing system in which the colorants generally comprise dry toners and the image is applied electrophotographically, it is also contemplated that the printing system may employ liquid or solid inks or other colorants and that the printing system may be an inket printing system, solid ink printing system, bubblejet printing system, or other image applying device.

As used herein, the term "multi-pass printing" generally refers to the rendering of an image by two (or more) passes through a marking engine and entails printing at least twice on the same side of a sheet. "Duplex printing" generally refers to printing on two sides of a sheet, which entails applying a first image in a first pass to one side of a sheet and a second image in a second pass to the opposite side of the sheet. The multi-pass printing method is particularly suited to the printing of company logos or other regions of an image which are desired to stand out from the remainder of the image.

Figure 2:
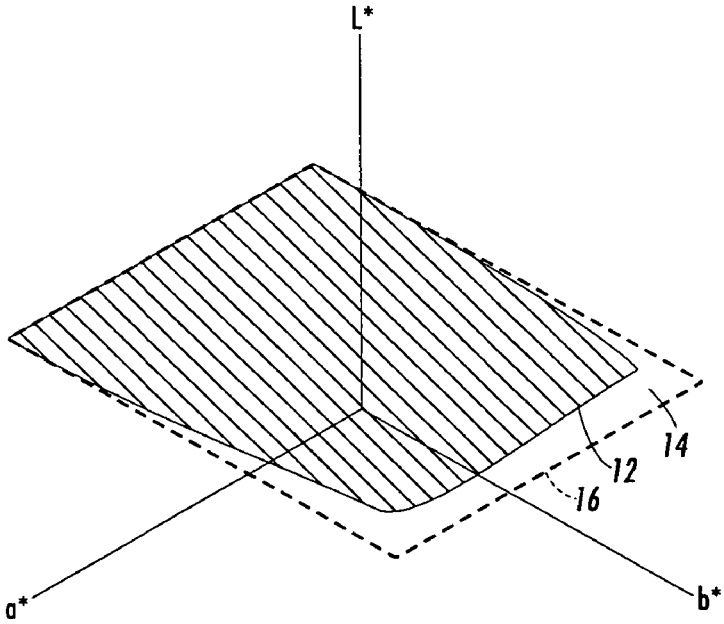
FIG. 2 is a schematic view of the transformation from an L*, a*, b* color space to a marking engine color space (CMYK) in accordance with the exemplary embodiment viewed as viewed at an angle to the L* axis.

With reference to FIGS. 1 and 2, a representative "slice" of color space in the visible spectrum is illustrated, showing the additive and subtractive primary colors. As is known in the art of color science, the slice illustrated in FIG. 1 is a section of a three-dimensional color space, L*, a*, b*, with the white-to-black neutral axis (L*) emerging from the center of the diagram out of the page, where a* corresponds to the red/green value and b* denotes the amount of yellow/blue. The slice illustrated in FIG. 2 is another section of the three-dimensional color space, L*, a*, b*, at an angle to the white-to-black neutral axis (L*). The L*, a*, b* representations are transformed into representations which the marking engine can reproduce with available colorants, such as cyan, magenta, yellow and black (CMYK) representations as shown by the inner crosshatched area 10 bounded by perimeter 12. This represents the color gamut which the marking engine can achieve in a single pass. Around the perimeter 12 of the section of color space are shown locations representing a full saturation of the subtractive primary colors yellow (Y), magenta (M), and cyan (C). These subtractive colors, as is well known, are used in the printing of images, because combinations of these colors can theoretically simulate all other colors in the visible spectrum.

The perimeter 12 indicates the colors which can be achieved with full saturation of one or more of the three primary colors C, M, and Y under normal practical operating conditions of the marking engine. Outside this region is a region 14 of expanded color gamut, which the marking engine cannot achieve within a single pass in its normal configuration (i.e., without changing the toner composition or developed mass of each pixel), but which can be achieved using a plurality of passes, such as with two (or more) passes through the marking engine For example, the hatched perimeter 16 bounding area 14 of the slice represents the maximum a*, b* values which the marking engine can reproduce with two passes. Within the area 14 are colors which tend to be more vivid (i.e., have higher chroma) as the perimeter 16 is approached. This is particularly true for the colors formed from a mixture of colorants, since the maximum chroma of the single pass pure colorants C, M, and Y are closer to the perimeter 16. In both FIGS. 1 and 2, it can be seen that the extended color gamut (represented by the combination of areas 10 and 14, bounded by perimeter 16), includes all the colors in the single pass color gamut (represented by the area 10, bounded by perimeter 12). The most significant benefits are seen at the lower L* values, as is evident from FIG. 2.

Figure 3:
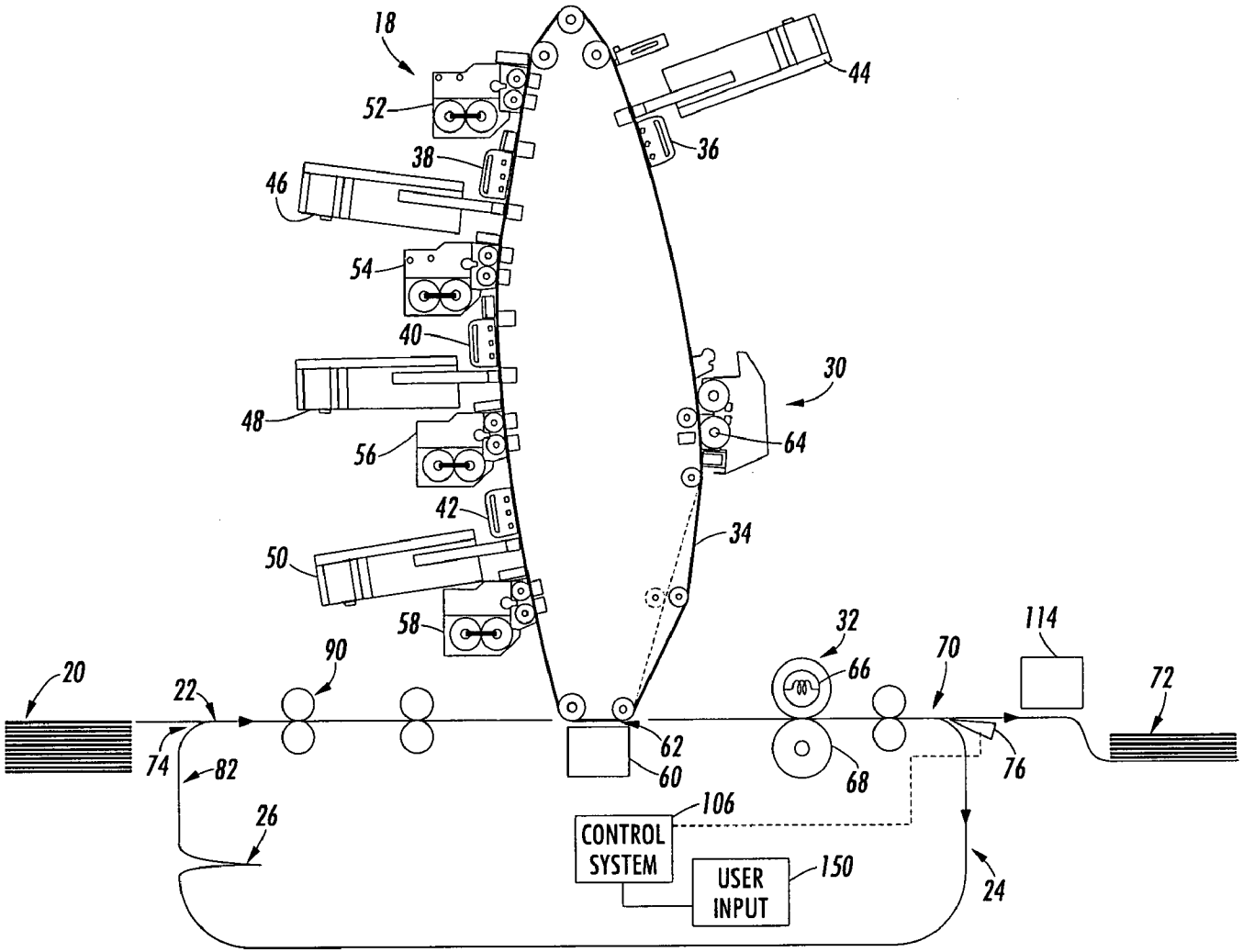
FIG. 3 is a schematic view of a printing system in accordance with a first aspect of the exemplary embodiment.

With reference to FIG. 3, an exemplary xerographic printing system suited to the rendering of images with an expanded color gamut is shown. The printing system includes a marking engine 18 which is configured for multi-pass printing. Print media, such as paper, is conveyed from a source 20 of print media, such as a paper tray, along a paper pathway 22 which passes through the marking engine 18. A return pathway 24 in the form of a loop returns print media which has been marked and fused by the marking engine 18 to the marking engine for a second pass through the marking engine. In one embodiment, the return pathway 24 includes an inverter 26 by which once printed media is inverted once for duplex (two sided) printing. Where a sheet is to be marked twice on the same side, for extending the color gamut, the sheet may be directed through the return loop twice, and is thereby inverted twice. The sheet thus passes through the marking engine 18 three times when a sheet is to be printed twice on the same side of the sheet. When duplex printing as well as multi-pass printing is desired, the same sheet may pass through the marking engine up to four times, thereby allowing multi-pass printing on both sides. For example, in pass No. 1, a first layer of the image for side 1 of the sheet is applied; in pass No. 2, a first layer of the image for side 2 of the sheet is applied; in pass No. 3, a second layer of the image for side 1 of the sheet is applied; and in pass No. 4, a second layer of the image for side 2 of the sheet may be applied. For ease of discussion, however, it is to be understood that unless otherwise indicated, where portions of an image are said to be applied in a "first pass" and in a "second pass" through the marking engine, the "second pass" may be any pass of the sheet through the marking engine which occurs subsequent to the "first pass," such as the pass No. 3 or pass No. 4 and the "first pass" can be any pass which precedes the "second pass."

Figure 4:
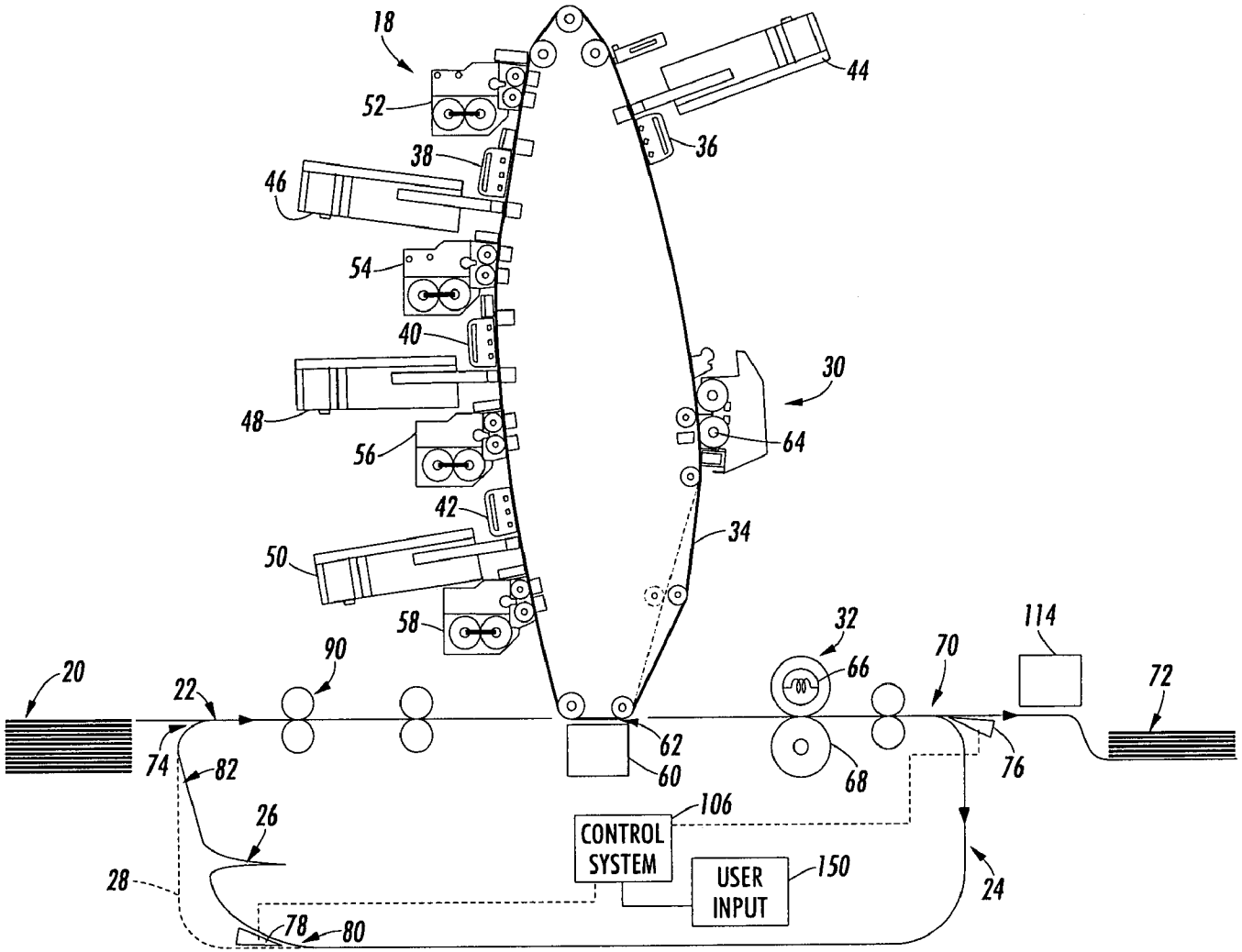
FIG. 4 is a schematic view of a printing system in accordance with a second aspect of the exemplary embodiment.

In another embodiment, illustrated in FIG. 4, which is the same as that of FIG. 3, except as otherwise noted, the return loop 24 includes a bypass pathway 28 by which the inverter 26 can be selectively bypassed when a sheet is to be printed twice on the same side. The bypass pathway 28 maintains the already printed media in the same orientation, i.e., with the printed side oriented for reprinting in the second pass.

The configuration of the marking engine 18 allows one or more colorants (toners in the illustrated embodiment) to be applied in a single pass through the marking engine. In the illustrated embodiment, the marking engine is configured for applying up to four colorants: cyan, magenta, yellow, and black (CMYK) in a single pass through the marking engine although it is also contemplated that the marking engine may be configured for applying fewer colorants, such as only the primary colorants C, M, and Y. In this case, black may be rendered by a combination of the C, M, and Y colorants.

In the case of a xerographic marking engine, for example, the marking engine includes various xerographic subsystems for forming an image, transferring the image to a sheet of paper, and fusing the image to attach the image more permanently to the print media. In the illustrated marking engine, an image applying component 30 applies an image to the print media, and a fixing device or fuser 32 fixes the applied image to the print media. The image applying component 30 of a xerographic system typically includes a charge retentive surface, such as a rotating photoreceptor 34 in the form of a belt or drum. The images are created on a surface of the photoreceptor. Disposed at various points around the circumference of the photoreceptor 34 are the xerographic subsystems, which include, for each of the colors to be applied, a charging station 36, 38, 40, 42, such as a charging corotron, an exposure station 44, 46, 48, 50 which forms a latent image on the photoreceptor, such as a Raster Output Scanner (ROS) or LED bar, a developer unit 52, 54, 56, 58 associated with each charging station 36, 38, 40, 42 for developing the latent image formed on the surface of the photoreceptor by applying a toner to obtain a toner image, a transfer unit 60, such as a transfer corotron, which transfers the toner image thus formed to the surface of the print media substrate, such as a sheet of paper, or to an intermediate transfer belt. In the illustrated embodiment, each of four toners cyan, magenta, yellow, and black (CMYK) is applied to the same photoreceptor 34 and the resulting image transferred to the print media at a transfer point 62 adjacent the transfer unit 60, although it is also contemplated that each colorant may be applied to a separate photoreceptor and thereafter to an intermediate transfer belt, as shown, for example, in U.S. Pat. No. 6,938,351 to Kobayashi, et al. entitled "IMAGE FORMING DEVICE," the disclosure of which, together with the references cited therein, is incorporated herein by reference. In either case, at the transfer point 62, the print media is brought into contact with the photoreceptor belt 34 (or transfer belt) for transfer of the image to the print media. Thereafter, the imaged print media is conveyed along the pathway 22 to the fixing device 32. The photoreceptor belt rotates past the transfer point 62 to a cleaning station 64, where a cleaning blade, brush or the like removes residual toner before the belt reaches the first charging station 36.

The fixing device 32 generally includes a heated roller 66 and a pressure roller 68 which define a nip therebetween.

The rendered image is permanently affixed to the print media in the fixing device 32 by the application of heat and pressure.

Downstream of the fixing device 32, is a junction 70 with return pathway 24. At the junction 70, the printed media may either continue along pathway 22 to an output destination 72, such as a paper tray, finishing device, or the like, or be diverted into return pathway 24. The return pathway 24 reenters the main pathway 22 at a junction 74 upstream of the transfer point 62. A switch 76 at junction 70 controls the route taken by the print media. In a first position of the switch, the print media continues along pathway 22, and in a second position, the print media is diverted into return pathway 24.

In the embodiment where a by pass pathway 28 is provided, a second diverter switch 78 controls the diversion of the print media into the bypass pathway 28. Specifically, print media traveling on pathway 24 may be diverted into pathway 28 at a junction 80 through selective operation of the switch 78. In the illustrated embodiment, the bypass pathway merges with the return loop 24 at a junction 82 although it is also contemplated that the bypass pathway 28 may rejoin the downstream pathway 22 at another location upstream of the transfer point 62 and/or be entirely separate from a pathway to the inverter 26.

The paper pathways 22, 24, 28 may be defined by baffles (not shown) which constrain the print media to travel in a particular direction. The print media is conveyed along the pathways 22, 24, 28 by a plurality of drive elements 90, illustrated as pairs of rollers, although other drive elements, such as airjets, spherical balls, belts, and the like are also contemplated.

Figure 5:
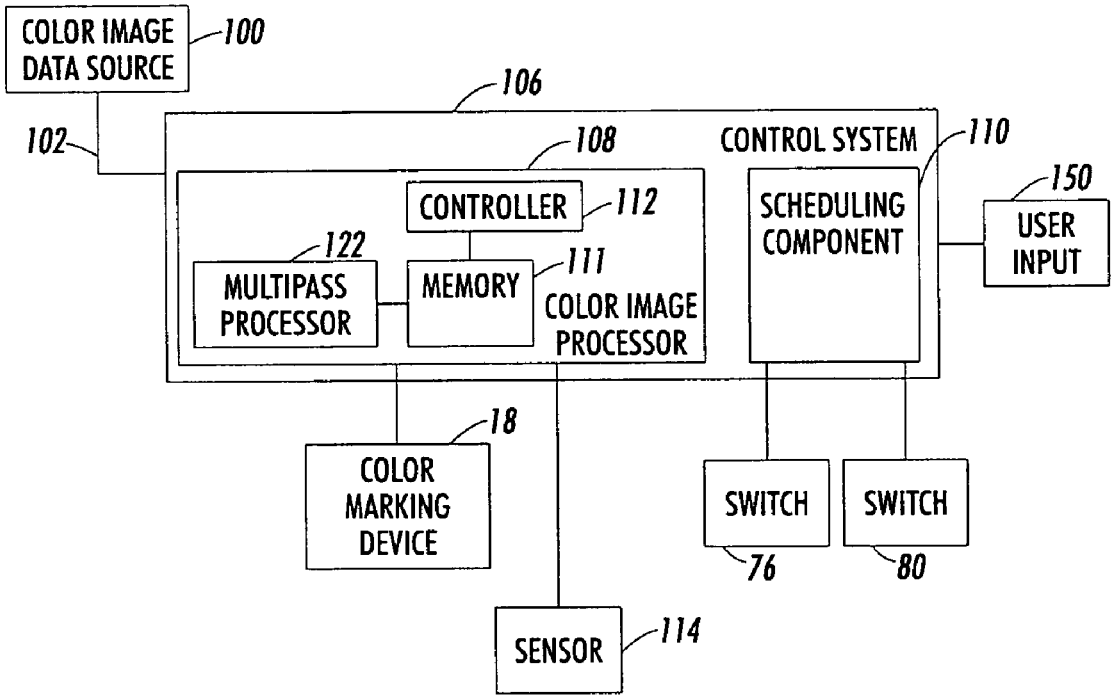
FIG. 5 is a block diagram of a printing system of FIG. 3, showing a control system.

With reference to FIG. 5, a functional block diagram of the exemplary printing system is shown. In addition to the process color marking device 18, the printing system includes a color image data source 100, which is connected by a link 102 to a control system 106 which serves as a marking engine processing component and which may incorporate what is known in the art as a digital front end (DFE). The printing system renders images, which are generally received in digital form, expressed in device independent color space, from the color image data source 100. The control system 106 processes the received original image data to produce print ready binary data that is supplied to the marking engine 18. In response to the print ready data, the marking engine 18 generates a printed image on the print media.

The color image data source 100 can be a locally or remotely located desk top or laptop computer, a personal digital assistant (PDA), a scanner, a facsimile machine, a digital camera, or a device suitable for storing and/or transmitting electronic color image data, such as a client or server of a network, or the Internet, and especially the World Wide Web, or any other device that is capable of supplying color image data to the printing system. The link 102 can be any suitable system for connecting the color image data source 100 to the control system 106, including a direct wired connection, a connection of an intranet, an extranet, the Internet, a local area network, a wide area network, a connection over the public switched telephone network, a connection over a coaxial cable (i.e., CATV) system, a connection over a cellular telephone network, a satellite connection or the like. The control system 106 receives the images to be rendered in the form of a print job which may comprise one or more pages and determines the image content of each page to be rendered in a raster image processing step. The control system 106 includes a color image processing component 108 and a scheduling component 110.

The control system 106 converts a color space of the image to be rendered into halftone densities of a plurality of colorants available within the marking engine. Specifically, the color image processing component 108 includes a memory 111 which stores one or more look up tables (LUTs) for converting the device independent color space values into device dependent (CMYK) values for rendering the image. The look up table(s) may include, for a plurality of colors within the color space, half tone densities which exceed those which the marking engine is capable of producing in a single pass. In general, the look up table(s) map the device independent input color values (e.g., CMYK or RGB) into the corresponding half tone output values for each of the colorants (such as C, M, Y and optionally K). The lookup table(s) optionally include one or more intermediate transformations, such as to L*, a*, b* values and may further include weightings to be applied to the basic look up table(s), which weightings are adjusted periodically to account for marking engine variations over time. While a single three or four dimensional look up table may be used which provides colorant values for each of the colorants, it is also contemplated that each of the colorants may be associated with its own look up table. Expressed on an 8 bit scale, for example, the colorant values may range from a minimum value of 0 (0% colorant) to a maximum value (100% colorant) of 255 for a single pass through the marking engine 18. Where the colorant values exceed 255, a portion of the colorant is applied in a first pass and a second portion of the colorant is applied in a second pass.

The color image processing component 108 includes a controller 112 which constructs and dynamically changes the mapping look-up table(s) contained in the memory 111. The memory 111 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-rewriteable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like.

A color sensor 114, such as, for example, a spectrophotometer, in communication with the color image processing component 108, evaluates printed test patches output by the marking engine 10. The color sensor 114 may be embedded in the paper pathway 22, downstream of the transfer point 62. In various other exemplary embodiments, the color sensor 114 is positioned within the output tray 72 or is an offline sensor. The controller 112 periodically updates the LUTs based on feedback from the sensor 114.

Figure 6:
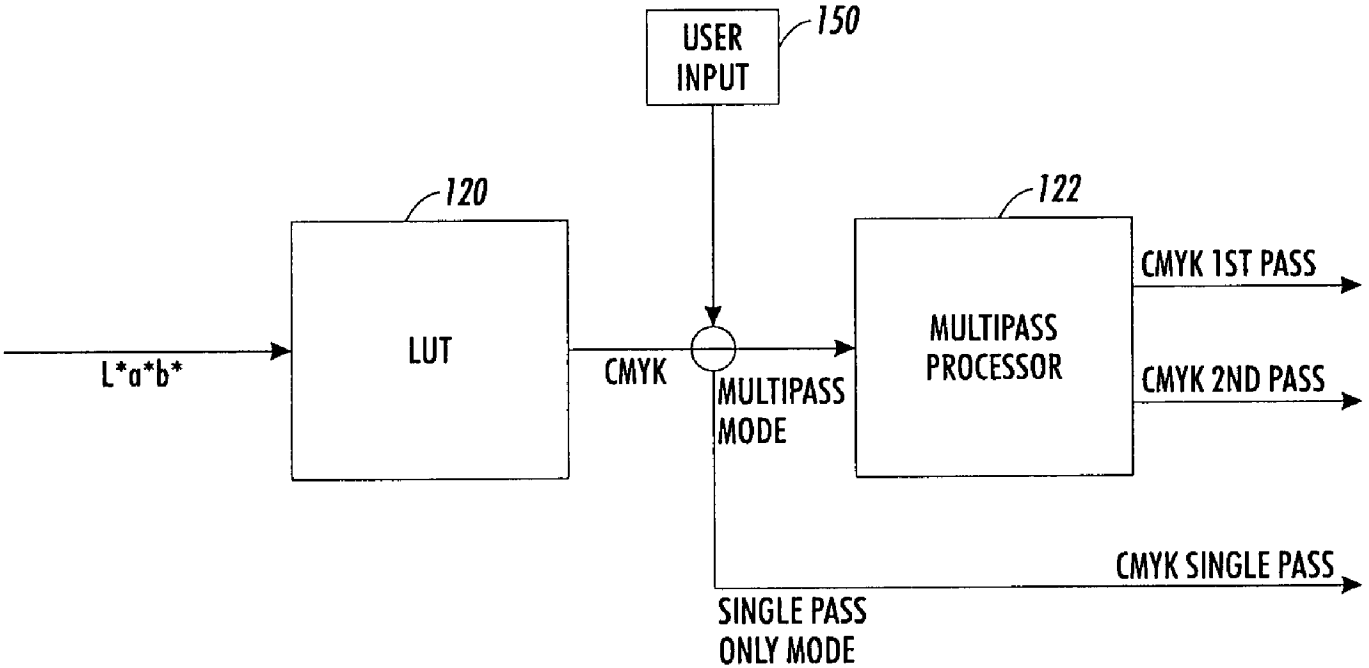
FIG. 6 illustrates schematically a look up table and a multi-pass processor for assigning colorant values for first and second passes through the marking engine of FIGS. 3-5.

As illustrated in FIG. 6, the memory 111 may include a multidimensional look up table 120 which converts the device independent input values to device dependent colorant output values. The output CMYK values are sent to a multi-pass processing component 122 which determines whether the colorant values exceed the color gamut of the marking engine For example, expressed in 8 bit terminology, where the values exceed 255, the multi-pass processing component 122 assigns a colorant value for a first pass and a colorant value for a second pass. To avoid registration problems and moiré effects, more of the colorant is applied in the first pass than in the second pass. In one embodiment, the maximum colorant value is applied in the first pass and the remainder is applied in the second pass. Thus, for example, where the colorant values for C, M, Y, and K assigned by the LUT 120 to a given area of the image are respectively 300, 210, 325, and 10, the multi-pass processor 122 assigns the maximum value of 255 to the first pass for cyan and the remainder of 45 to the second pass. Similarly, the multi-pass processor 122 assigns the maximum value of 255 to the first pass for yellow and the remainder of 70 to the second pass. For magenta and black, these colors can be applied in a single pass, generally the second pass. Thus, the multi-pass processor 122 assigns the minimum value of 0 to the first pass for magenta and black and the full amount of 210 and 10 respectively to the second pass. Because the second layer applied in the second pass is imperfectly opaque (partially translucent) the colorants applied in the first pass are visible in the resulting image. The multi-pass processor 122 sends the output CMYK values for the first and second passes to the marking engine for rendering the first and second passes for forming the image. It will be appreciated that while the printing of images which fall outside the color gamut has been described in terms of a single multidimensional LUT, it is also contemplated that there may be separate LUTs for the first and second passes or other arrangements for determining the colorant values for the first and second passes.

For many of the images to be rendered by the marking device 18, a first and only pass may be sufficient to render the image. In such cases, the multi-pass processor 122 may generate a single output corresponding to the colorant values for a single pass. Certain areas of the image may have output values which fall within the color gamut which can be achieved on the first pass. Those areas do not need to be printed again in the second pass.

The scheduling component 110 is in communication with the color image processing component 108 and is notified by the color image processing component when an image to be rendered falls outside the color gamut of the marking device and will require multi-pass printing in order to render the image more accurately. The scheduling system communicates with the switch 76 for routing the print media to be multi-pass printed back to the transfer point 62 where the portion of the image receiving a second pass is applied.

Figure 7:
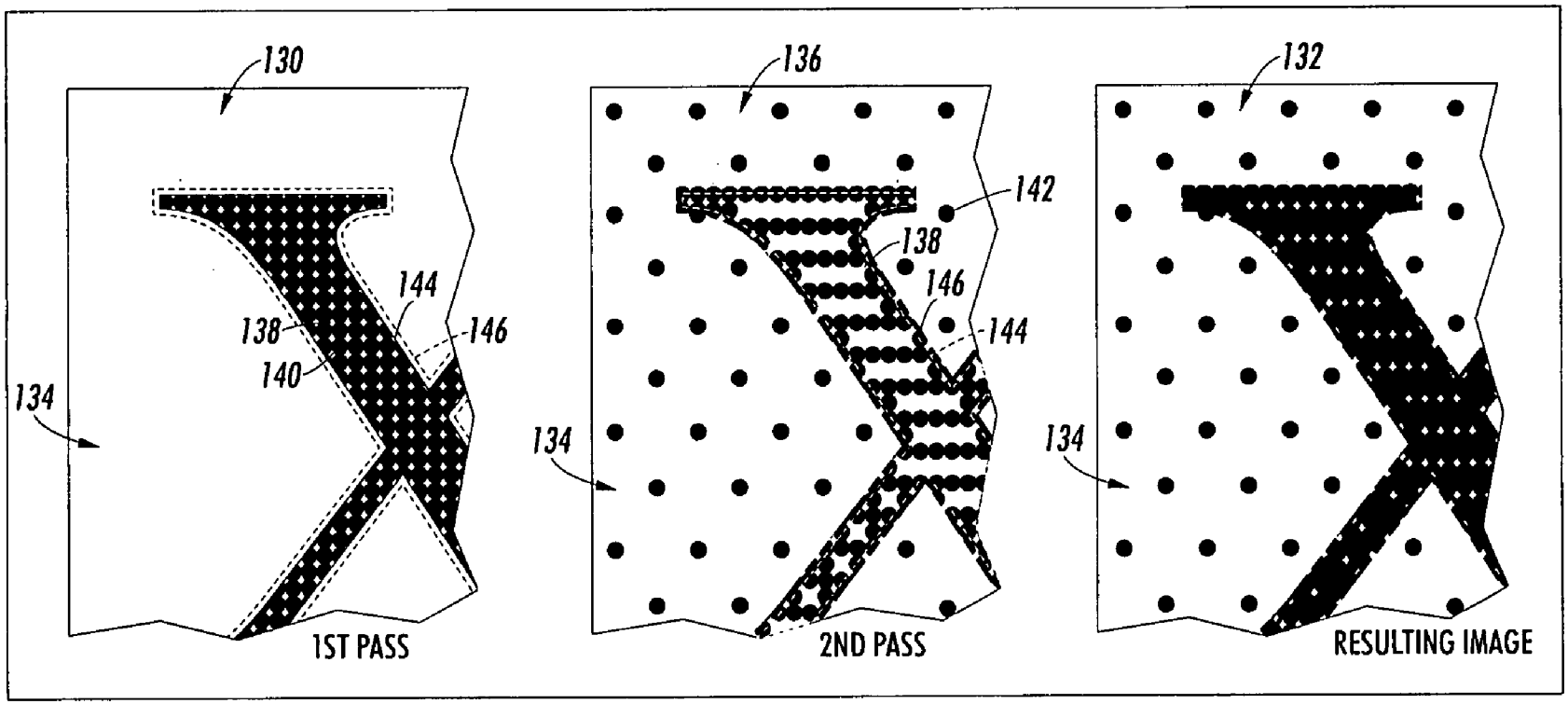
FIG. 7 illustrates forming an image in two layers.

FIG. 7 illustrates a layer 130 of an image 132 which is applied to a substrate 134 in a first pass and a layer 136 of an image 132 which is applied to the substrate 134 in a second pass. The resulting image 132 is formed from the two layers. In one aspect, in multi-pass printing, at least an area 138 of the rendered image is formed by applying a colorant in the first pass and applying the same colorant to the area 138 in the second pass. For example, one or more of a plurality of colorants are applied in the first pass (such as the colorants for forming the pixels 140 of the red letter X); and at least one of the colorants which were applied in the first pass is also applied in the second pass. In the illustrated case one or more of the colorants for forming the pixels 140 of the red letter X is again applied to the area 138. In some aspects, more than one colorant is applied in the first and/or second passes. In another aspect, a different colorant, selected from the plurality of available colorants, is applied in the second pass through the marking engine 18. In the illustrated case, black colorant is applied as pixels 142 of the second layer for forming a gray background.

In one aspect, the control system 106 identifies an area 138 of the image which is scheduled to be marked in both a first pass and a second pass and adjusts the area to be marked in one of the passes such that one pass is imaged in a smaller area than the other pass. For example, the area to be marked in the first/second pass is adjusted such that a perimeter 146 of the area scheduled to be marked within the second pass falls outside a perimeter 144 of the area scheduled to be marked in the first pass. This reduces the likelihood that color plane misregistration may result in undesirable fringing problems. For example, in determining the output values for the pixels to be printed in the areas to be printed in the first and second passes, the multi-pass processor 122 may increase the size of the area to be reprinted in the second pass by adding pixels around a perimeter of the area to be reprinted or may decrease the size of the area to be printed in the first pass by omitting those pixels which lie adjacent a perimeter of the area to be reprinted. In general, fringing is minimized where the color plane in which the majority of the colorant is being applied is the plane in which the perimeter of the area being printed twice is of reduced size as compared with that of the color plane where the minority of the colorant is to be applied. Thus, if more of the colorant is applied in the second pass than in the first pass, the perimeter of the area to be printed twice is slightly larger in the first pass than in the second pass.

Exemplary systems which may be utilized to reduce skewing and improve sheet registration in the printing system are described, for example, in U.S. Pat. No. 6,173,952 to Richards, et al., entitled "PRINTER SHEET DESKEWING SYSTEM WITH AUTOMATIC VARIABLE NIP LATERAL SPACING FOR DIFFERENT SHEET SIZES," and U.S. Pat. No. 6,920,307 to Howe entitled "SYSTEMS AND METHODS FOR SIMPLEX AND DUPLEX IMAGE ON PAPER REGISTRATION," the disclosures of which are incorporated herein in their entireties, by reference. It will be appreciated that even though the same pixel in the image may be printed in both the first and the second passes, due to minor changes in registration, the colorant applied may be slightly offset in the second pass.

In one aspect a user input 150 (FIG. 5), such as a switch, keyboard, or touchscreen, enables an operator to select between a mode which permits multi-pass printing and a mode in which only single pass printing for a given image is permitted. When the single pass printing mode is selected, the image is rendered in a single pass, even if it falls outside the color gamut. This allows the printing system to operate at high productivity, and is particularly suited to printing of print jobs where color rendering is not of particular concern. For such print jobs, the printing system renders the image to the best extent possible with a single pass. The multi-pass processor may be bypassed in this mode. In the multi-pass mode, the multi-pass processor 122 determines whether more than one pass is needed to render the image and, if so, assigns colorant values for the first and second (and optionally subsequent) passes.

While the scheduling component 110 and color image processor 108 are illustrated as components of an overall control system 106, it is to be appreciated that these processing components may be distributed throughout the printing system or located elsewhere, such as in a workstation or other color image data source. The various processing components of the printing system, such as the scheduling component 110 and color control component 108, may be embodied in any suitable software or hardware. Moreover, the disclosed methods may be readily implemented as software executed on a programmed general purpose computer, a special purpose computer, a microprocessor, or the like. In this case, the methods and systems of the exemplary embodiments described herein can be implemented as a routine embedded on a microprocessor such as Java® or CGI script, as a resource residing on a server or graphics work station, as a routine embedded in a dedicated print management system, web browser, web TV interface, PDA interface, or the like.

During operation of printing system, the control system 106 receives print jobs comprising images to be rendered from the color image data source 100 and identifies information comprising the image content associated with each page. As described above, the method of printing includes accessing a lookup table 120 which converts a color space of the image into halftone densities of a plurality of colorants available within the marking engine, the look up table including, for a plurality of colors within the color space, half tone densities which may exceed those for a first pass through the marking engine. The multi-pass processor 122 identifies pages comprising an image which falls outside the single pass color gamut of the marking engine and the scheduling component 110 schedules a plurality of passes through the marking engine for rendering the image. Other pages are identified as pages to be single pass printed and are scheduled to be passed through the marking engine only once.

The scheduling component 110 determines the order of printing of each page to ensure that the pages arrive at the output destination 72 in output order. For example, a page which is to be multi-pass printed may be scheduled out of order for the first pass printing, such that another page is at the transfer point while the print media for the page to be multi-pass printed is in the return loop 24.

When a sheet is to be printed more than once, the method includes directing the print medium to receive a second pass along a pathway which returns print media for a second pass through the marking engine. In particular, the scheduling component 110 communicates with the switch 76, which is moved from a first position where the printed media continues along pathway 22, to a second position in which the printed media is directed on loop 24 and is returned to the transfer point 62. Where a bypass pathway 28 is provided, for multi-pass printing, the sheet is not inverted and switch 80 is set in a position for the printed media to bypass the inverter 26. Otherwise, a third pass is used intermediate the first and second passes and the sheet is thereby inverted twice. Once the multi-pass image or images have entered the return loop 24 for the second pass, the switch may be returned to its normal position and the printed media is directed to the output destination 72.

The LUT 120 is periodically adjusted to compensate for machine variations (e.g., by adjusting the weightings). A printed image, such as a test sheet comprising a plurality of test patches, is evaluated back in (L*,a*,b*) or other color space using a suitable measurement device 114 such as a calorimeter or a spectrophotometer. The color controller 112 attempts to maintain consistent color by making adjustments to the LUT according to colorimeter/spectrophotometer measurements of the printed image.

The multi-pass system described is able to render colors with a greater degree of accuracy than a single pass system. For example, of the 1089 colors in the Pantone system a conventional printing system is able to reproduce 486 of the colors (44.6%) to a level where differences are not generally detectable by the human eye. The same printing system, using a two-pass mode, where appropriate, is able to reproduce 580 colors (53.3%) with the same level of accuracy.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic printing system comprising:

a marking engine which applies colorants to a print medium to render an image, the marking engine having a single pass color gamut which the marking engine is capable of rendering in a single pass of the print medium through the marking engine and an extended color gamut which the marking engine is capable of rendering in a plurality of passes of the print medium through the marking engine; and a control system associated with the marking engine which identifies an image which falls outside the single pass color gamut of the marking engine and schedules a plurality of passes for rendering the image, wherein an area of the rendered image is formed by applying a colorant in a first pass through the marking engine and applying the same colorant to the area in a second pass through the marking engine.

2. The xerographic printing system of claim 1, further comprising a return pathway for returning print media to the marking engine for a second pass through the marking engine.

3. The xerographic printing system of claim 2, wherein the return pathway includes an inverter and wherein the control system schedules at least three passes through the marking engine.

4. The printing system of claim 2, further comprising a fixing device for permanently affixing the image to the print medium, the return pathway being located downstream of the fixing device for returning print media with fixed images for a second pass through the marking engine.

5. The xerographic printing system of claim 1, wherein the control system includes a multi-pass processing component which assigns a first colorant value to an area of the image to be rendered for a first pass through the marking engine and a second colorant value for the same colorant to the area of the image to be rendered for a second pass through the marking engine.

6. The xerographic printing system of claim 1, wherein the control system identifies an area of the image which is scheduled to be marked in both a first pass and a second pass and adjusts the area to be marked in one of the first and the second pass such that a perimeter of the area scheduled to be marked in one of the first and the second passes falls within a perimeter of the area scheduled to be marked in the other of the first and the second passes.

7. The xerographic printing system of claim 1, wherein the colorants comprise toners.

8. The printing system of claim 1, wherein in the first pass, the marking engine applies at least one of a plurality of colorants and in the second pass, the marking engine applies more than one of the plurality of colorants including the at least one colorant applied in the first pass.

9. The printing system of claim 1, wherein the control system further identifies an image which falls within the single pass color gamut of the marking engine and schedules a single pass for rendering the image.

10. A xerographic printing system comprising:

a marking engine which applies colorants to a print medium to render an image, the marking engine having a single pass color gamut which the marking engine is capable of rendering in a single pass of the print medium through the marking engine and an extended color gamut which the marking engine is capable of rendering in a plurality of passes of the print medium through the marking engine; and a control system associated with the marking engine which identifies an image which falls outside the single pass color gamut of the marking engine and schedules a plurality of passes for rendering the image, the control system including a look up table for converting a color space of the image into halftone densities of a plurality of colorants available within the marking engine, the look up table including, for a plurality of colors within the color space, half tone densities which fall outside the single pass color gamut of the marking engine.

11. The xerographic printing system of claim 10, wherein an area of the rendered image is formed by applying a colorant in a first pass through the marking engine and applying the same colorant to the area in a second pass through the marking engine.

12. A printing system comprising:

a marking engine which applies colorants to a print medium to render an image, the marking engine having a single pass color gamut which the marking engine is capable of rendering in a single pass of the print medium through the marking engine and an extended color gamut which the marking engine is capable of rendering in a plurality of passes of the print medium through the marking engine, wherein the extended color gamut includes the single pass color gamut; and a control system associated with the marking engine which identifies an image which falls outside the single pass color gamut of the marking engine and schedules a plurality of passes for rendering the image.

13. A method of printing comprising:

applying at least one of a plurality of colorants to a print medium in a first pass through a xerographic marking engine;

applying at least one colorant from the plurality of colorants to the print medium in a second pass through the xerographic marking engine to render an image, whereby the rendered image includes at least one area in which a rendered color falls outside a color gamut of the xerographic marking engine for a single pass of the print medium through the xerographic marking engine, whereby an area of the rendered image is formed by applying a colorant in the first pass and applying the same colorant in the second pass.

14. The method of claim 13, further comprising:

identifying an image which falls outside the single pass color gamut of the marking engine and scheduling a plurality of passes through the marking engine for rendering the image.

15. The method of claim 13, further comprising:

directing the print medium to receive a second pass along a pathway which returns print media for a second pass through the marking engine.

16. The method of claim 13, further comprising:

accessing a lookup table which converts a color space of the image into halftone densities of a plurality of colorants available within the marking engine, the look up table including, for a plurality of colors within the color space, half tone densities for which exceed those which the marking engine is capable of rendering in a first pass through the marking engine.

17. The method of claim 13, further comprising:

identifying an area of the image which is scheduled to be marked in both a first pass and a second pass and adjusting the area to be marked in one of the first and second passes such that a perimeter of the area scheduled to be marked in one of the the first and second passes falls within a perimeter of the area scheduled to be marked in the other of the first and second passes.

18. The method of claim 13, further comprising:

applying an additional colorant from the plurality of colorants in the second pass.

19. The method of claim 13, further comprising:

in the first pass, transferring the colorants to be applied to the print medium at a transfer point which is the same for all the colorants; and in the second pass, transferring the colorants to be applied to the print medium at the transfer point.

20. A printing system comprising:

a marking engine configured for rendering an image by applying a plurality of colorants to a print medium at a transfer point;

a color image processing component which identifies at least one image from images to be rendered; and a scheduling component which schedules return of the identified at least one image to the transfer point, whereby the at least one image is marked with at least one of the plurality of colorants at the transfer point and returned to the transfer point to be marked with at least one of the plurality of colorants, the scheduling system returning fewer than all the images to be printed to the transfer point.

* * * * *

UNITED STATES PATENT AND TRADEMARK OFFICE

CERTIFICATE OF CORRECTION

PATENT NO. : 7,305,200 B2
APPLICATION NO. : 11/261341
DATED : December 4, 2007
INVENTOR(S) : Matthew F. Hoffmann et al.

It is certified that error appears in the above-identified patent and that said Letters Patent is hereby corrected as shown below:

Title page item (75) Inventors, should read as follows: Matthew F. Hoffmann, Ontario, NY (US); Paul M. Butterfield, Ontario, NY (US); Mark P. Haefner, Pittsford, NY (US); Christopher J. DeGroff, Webster, NY (US)

Signed and Sealed this

Tenth Day of June, 2008

JON W. DUDAS
*Director of the United States Patent and Trademark Office*